US005451256A

United States Patent [19]

Morton

[11] Patent Number: 5,451,256

[45] Date of Patent: Sep. 19, 1995

[54] APPARATUS FOR PREPARING A SMOOTH SURFACED TOUGH ELASTOMERIC COATED FIBROUS BATT

[75] Inventor: L. Keith Morton, Greenville, S.C.

[73] Assignee: Schuller International, Inc., Denver, Colo.

[21] Appl. No.: 62,677

[22] Filed: May 17, 1993

Related U.S. Application Data

[62] Division of Ser. No. 824,179, Jan. 22, 1992, Pat. No. 5,211,988.

[51] Int. Cl.[6] ..... B05C 11/02; B05C 13/00

[52] U.S. Cl. ..... 118/59; 118/68; 118/106; 118/126

[58] Field of Search ..... 118/59, 68, 641, 643, 118/106, 123, 126

[56] References Cited

U.S. PATENT DOCUMENTS 3,192,893 7/1965 Bauer ..... 118/106
3,936,254 2/1976 Sawada ..... 118/106
5,225,140 7/1993 Hayashikoshi ..... 118/106

*Primary Examiner*—Michael W. Ball
*Assistant Examiner*—Daniel J. Stemmer
*Attorney, Agent, or Firm*—Cornelius P. Quinn

[57] ABSTRACT

A process for providing a relatively smooth, tough, elastomeric coating over one surface of a fibrous batt employs a heated ironing surface which engages an uncured coating of a composition of cross-linkable elastomeric aqueous emulsion applied as a foam or froth to an exposed surface of a fibrous batt. The heated belt causes dewatering and cure of a film of the coating which is in contact with the ironing surface. The fibrous batt thereafter is heated in a curing oven to drive off substantially all of the moisture and substantially cure all of the elastomeric coating composition. The resulting coated fibrous batt has a smoother and tougher surface than similar batts formed from similar compositions without the interposed ironing treatment. A preferred ironing element comprises a continuous stainless steel belt.

2 Claims, 4 Drawing Sheets

Fig. 4

APPARATUS FOR PREPARING A SMOOTH SURFACED TOUGH ELASTOMERIC COATED FIBROUS BATT

This application is a division of Ser. No. 07/824,179, filed Jan. 22, 1992, now U.S. Pat. No. 5,211,988.

BACKGROUND OF THE INVENTION

1. Field Of The Invention

This invention concerns fibrous batts of thermal insulation and more particularly concerns a method and apparatus for producing a smooth, tough elastomeric coating over one surface of a fibrous batt.

2. Description Of The Prior Art

Fibrous batts of glass fibers are employed as thermal insulation and acoustical insulation in a variety of products, for example, ventilation duct-liners, automotive hood lid liners, et cetera. Tough, elastomeric coatings are applied to the exposed surface of such fibrous batts in order to retard separation of fibers and to reduce air friction losses in ducts which are lined with such batts. The coatings also increase the ease of handling the batts.

Typically such batts are coated on one surface with an elastomeric aqueous cross-linkable emulsion composition such as an acrylic emulsion which is heat cured after application. Such elastomeric cross-linkable compositions have been frothed or foamed in order to provide uniform coating of the exposed surface of the batt over the irregular and uneven surface of the batt. During thermal exposure such emulsion coating compositions lose water and the frothed or foamed coatings collapse (i.e., coalesce and eliminate bubbles from the froth or foam). Continuous thermal exposure cross-links the elastomeric resins to a tough coating which provides an economical, thin exposed coating which generally conforms to the irregularities of the initial fibrous batt. The resulting relatively rough and uneven surface is objectionable in ventilation duct liners for several reasons. Airborne dust and particles tend to accumulate in the surface irregularities. Viri, bacteria and pathogens tend to accumulate in the irregularities of the surface. Irregular surfaces increase the frictional resistance of air moving through the lined ducts. Smoother surfaces tend to reduce the frictional resistance of the lined ducts to the flow of air.

Cross-linkable aqueous emulsions are available from several sources. A cross-linkable emulsion contains monomers and polymers, some of which have multiple polymerizable sites to effect cross-linking to a three-dimensional polymer. Aqueous acrylic emulsions are preferred. Any cross-linkable aqueous acrylic emulsion which is not a pressure-sensitive adhesive is acceptable.

STATEMENT OF THE PRESENT INVENTION

According to the present invention, an improved elastomeric coated fibrous batt has been developed which provides a relatively smooth surface which is dramatically tougher than similar surfaces manufactured from the same coating composition on the same fibrous batt without employing this invention.

The invention is an improvement in the known fibrous batt-coating procedure which involves applying a foamed or frothed cross-linkable elastomeric aqueous emulsion composition to one surface of a fibrous batt and thereafter heating the batt with the applied coating in order to drive off the aqueous carrier for the emulsion, to collapse the foam or froth, and to cure the cross-linkable elastomer. Such coatings are known to possess as additives: fire-retardant agents, bactericides, fungicides, pigments, rheology modifiers, curing catalysts and other additives.

According to the present invention, the frothed or foamed cross-linkable elastomeric aqueous emulsion coating is contacted with the heated ironing surface prior to drying or curing of the coating composition. The ironing surface dewaters and cures a film of the coating composition which is in contact with the ironing surface without dewatering and curing the entire coating composition. The ironing surface compresses the coating composition whereby the exposed film conforms generally to the configuration of the smooth ironing surface. The ironing surface contact is achieved without creating shear stress between the ironing surface and the coating composition. Preferably the batt which is being coated advances at a uniform speed through a coating line; the ironing surface is a continuous smooth belt having a linear velocity corresponding to the velocity of the batt in the coating line. The coating composition develops substantial cohesive strength which facilitates separation of the ironing surface from the coating. Mold release agents may be applied to the ironing surface to facilitate the separation of the cured coating film and the ironing surface.

A preferred ironing surface is a continuous belt of smooth, heat transfer material such as stainless steel. The belt is driven between at least one pair of rollers which are mounted in a frame which can be adjusted to provide appropriate compression of the coating composition to develop the desired smooth surface. After the cured surface film is developed, the batt and coating composition are heated to drive off the aqueous vehicle from the composition and to cure the cross-linkable composition.

The resulting coated fibrous batt has a significantly smoother surface in appearance and in touch than previous coated fibrous batts. The number and size of the surface irregularities in the resulting coated fibrous batt are significantly reduced. In addition, the coating of the fibrous batt is dramatically tougher than the coating of prior art coated fibrous batts.

Accordingly it is an object of the present invention to provide a method for producing smooth, tough elastomeric coatings over one surface of a fibrous batt.

It is another object of the present invention to provide apparatus for producing smooth elastomeric coated fibrous batts.

It is a further object of the invention to produce a new smooth-surfaced, coated fibrous batt, substantially free of exposed fibers and substantially free of surface irregularities.

DESCRIPTION OF THE PREFERRED EMBODIMENTS

Fibrous batts are customarily fabricated by forming and shaping randomly deposited glass fibers into a generally rectangular cross-section in continuous lengths. Typically such batts are from ½ inch nominal thickness to about 2 inches nominal thickness. The glass fibers customarily are coated with thermoset resins by the batt manufacturer or the fiber manufacturer prior to shipping the batts. When heated, the resins which are heat-cured to provide relative rigidity and structural integrity to the resulting batts. Such batts are typically used as thermal insulation and acoustical insulation materials. Such batts are available in widths from about 2 feet to 8 feet. The continuous batts are normally cut-to-length as desired, typically about 25 feet, 50 feet, 100 feet.

Figure 1:
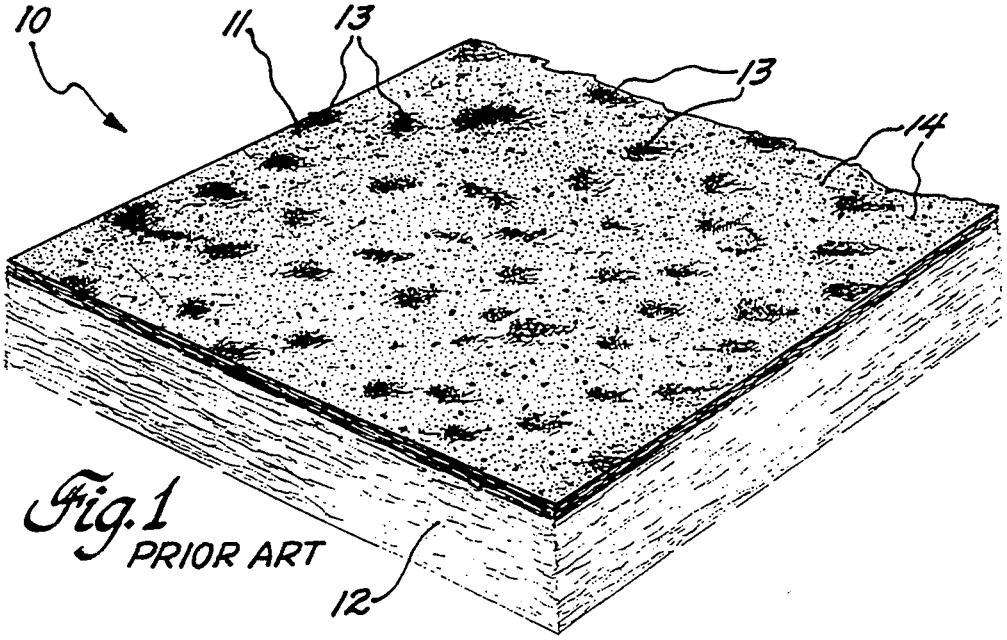
Fig. 1 PRIOR ART
FIG. 1 is an isometric view of a typical coated fibrous batt according to the prior art.
Figure 2:
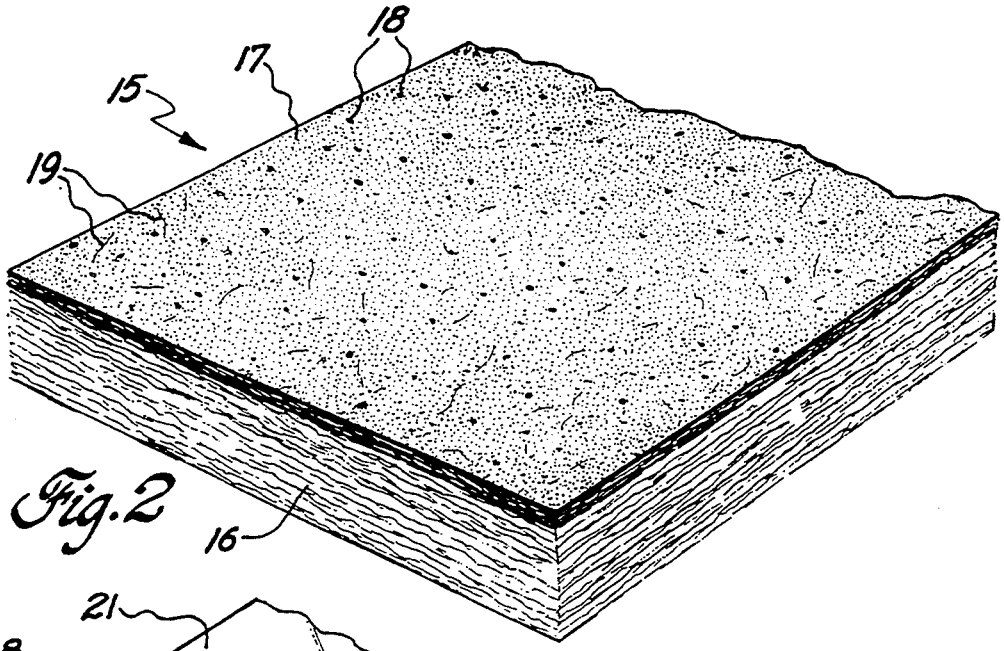
FIG. 2 is an isometric sketch similar to FIG. 1 showing the coated fibrous batt resulting from the practice of the method of the invention.

As shown in FIG. 1, a prior art glass fiber batt 10 typically has an elastomer coating 11 over one surface of the batt 12. The average thickness of the coating 11 is from 5 to 30 mils. As seen in FIG. 1, the prior art coatings 11 generally follow the irregular contour of the glass fiber batt 12 and present depression 13 and exposed glass fibers 14 which contribute to the irregularity of the exposed surface of the coating 11.

By comparison, a coated batt 15 includes a glass fiber batt 16 and a cured coating 17. It will be observed that the coating 17 has fewer and smaller depressions 18 and fewer exposed fibers 19.

Figure 3:
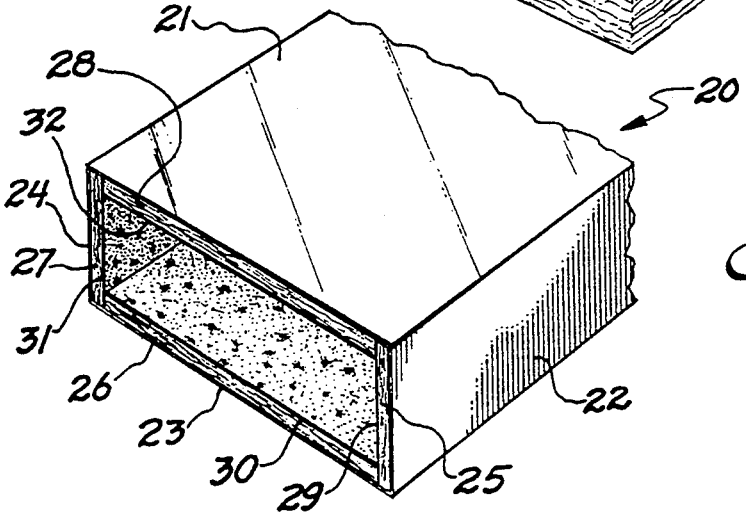
Fig. 3 PRIOR ART
FIG. 3 is a fragmentary perspective illustration of a typical air distribution duct lined with coated fibrous batts.

Typically coated fibrous batts are employed as liners in ventilation ducting as illustrated in FIG. 3, a ventilation duct 20 normally has a rectangular cross-section formed from metal surfaces 21, 22, 23, 24. The duct is lined with coated glass fibrous batts 25, 26, 27, 28. The batts 25, 26, 27, 28 are secured to the inner duct walls by suitable means, such as adhesives (not shown), fasteners or brackets. The batts are coated over an exposed surface prior to being mounted in the duct 20. The batt coatings 29, 30, 31, 32 secure the glass fibers in the respective batts and retard any transport of glass fibers through the duct. The coatings 29, 30, 31, 32 have a generally irregular surface in the prior art (See FIG. 1.) corresponding to the irregular surface of the glass batts which results in significant frictional resistance to the flow of air through the duct 20. The irregularities of the coated surfaces become pockets for accumulation of dust, viri, bacteria and pathogens.

The smooth, tough coatings of this invention provide substantially smoother surfaces and consequent lower frictional resistance to the flow of air through the duct 20 and substantially reduce surface irregularities which might function as collectors of dust, viri, bacteria and pathogens. Because the coatings of the present invention are substantially tougher than those of the prior art, the opportunities for tearing, puncturing or other destruction of the coating are reduced during packaging, shipment, and handling by installers.

Figure 4:
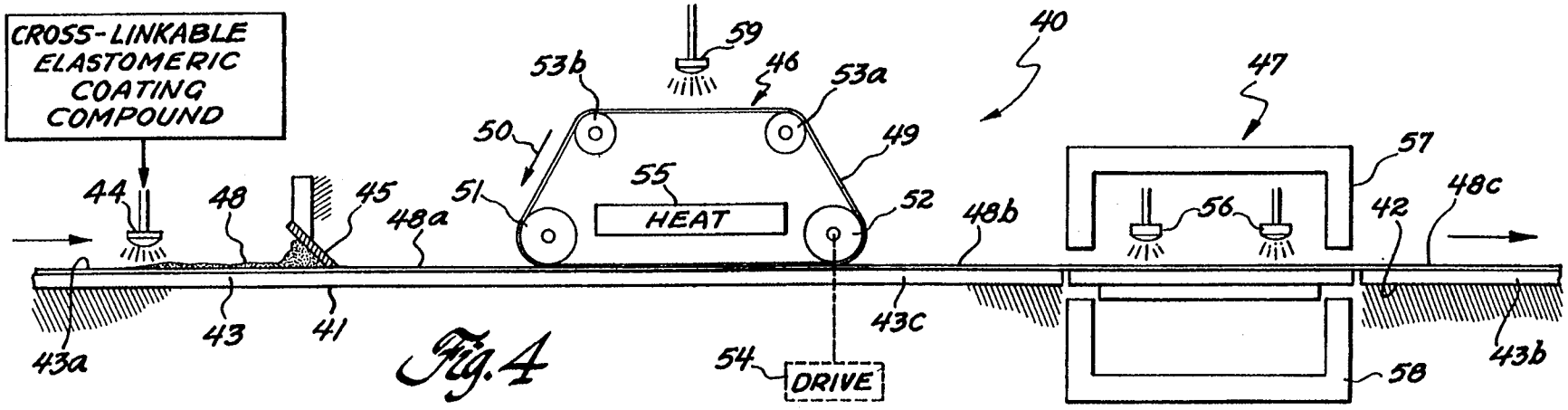
FIG. 4 is a schematic illustration of one embodiment of apparatus for practicing the invention.

Referring to FIG. 4 there is illustrated a schematic production line for the coated fibrous batts of this invention. The assembly line 40 includes level tables 41, 42 which guide a fibrous batt 43 sequentially through a coating applicator 44, a doctor blade 45 or similar thickness control device; an ironing apparatus 46 for a coated surface, and a heating chamber 47.

The continuous batt 43 of glass fibers moves from left to right from an uncoated state **43*a* to a final coated state 43*b*. A coating in the form of a froth or foam 48 is applied to the batt 43 from a coating applicator 44. The coating 48 is shaped into a uniform level coating by means of a doctor blade 45 or similar leveling device, e.g., a coating roller. The level coating 48*a* passes in contact with the heated ironing apparatus 46, more fully illustrated in FIG. 5, which comprises a moving continuous stainless steel belt 49 moving in the direction indicated by the arrow 50 between a pair of rollers 51, 52. A heat source 55 supplies heat to the continuous belt 49 which is transmitted to the coating 48 in contact with the smooth outer surface of the belt 49. The heat serves to drive moisture from a film of the coating engaging the belt 49 and also achieves a cross-linking cure of the film of coating. As the film 48*b* advances beyond the ironing station 46, the coating has an outer relatively smooth, partially-cured film and is essentially uncured between that film and the fibrous batt 43*b*. The heating source 55 may be a gas burner, electrical radiant heater, or any other suitable heater which will cause the temperature of the continuous belt 49 to reach the desired level for drying and curing the exposed outer film of the coating 48*a***.

The coated fibrous pad **43*c* with the cured exposed film passes through a heating zone 47 positioned between the table 41 and the table 42. Within the heating zone 47, a heat source 56 maintains an oven temperature sufficient to drive off substantially all of the moisture in the coating 48*b* and to effect a complete cure of the elastomer in the coating 48*c*. The heating source 56 may comprise infra-red lamps or a radiant gas burner, or other appropriate devices. The heating zone 47 is preferably lined with thermal insulation 57, 58** for thermal efficiency.

The coated fibrous batt **43*b* leaving the heating zone 47 has a relatively smooth, tough, cured, dried elastomeric coating over an exposed surface. The coated batt 43*b*** is normally cut to length and packaged for shipment.

Figure 5:
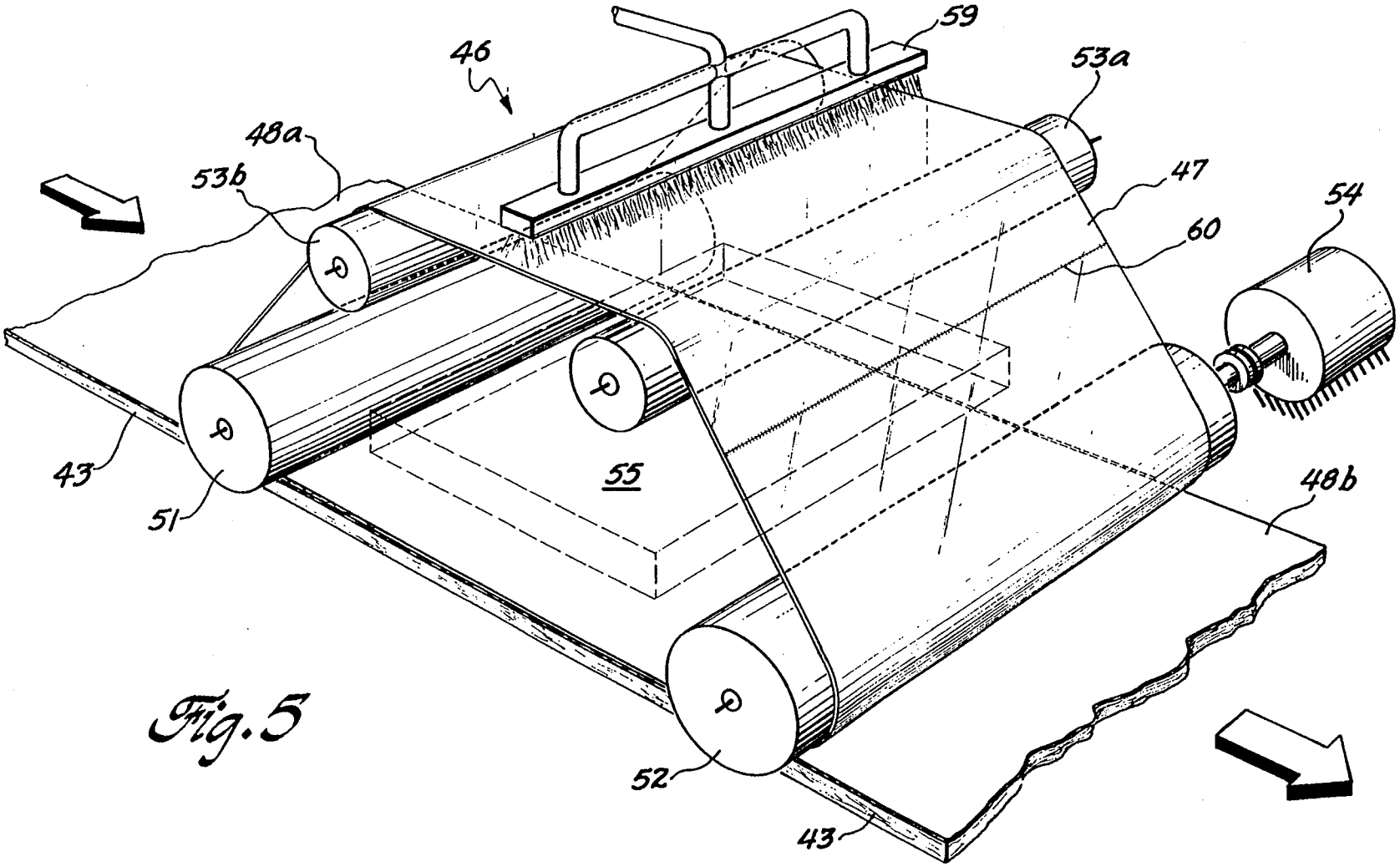
FIG. 5 is a perspective illustration of the ironing surface portion of the apparatus shown in FIG. 4.

As indicated in FIG. 5, the ironing belt 49 is supported by rollers **51, 52, 53*a*, 53*b*. The continuous belt 49 preferably is a stainless steel belt. At least one of the rollers 51, 52, 53*a*, 53*b* is moveable horizontally and/or vertically to adjust the tension in the belt 49. All of the rollers 51, 52, 53*a*, 53*b* are secured to a frame (not shown in FIG. 5) which can be moved to provide more or less compressive stress against the coating 48*a*. If desired, appropriate means, e.g., a spray 59, may be provided to spray or otherwise apply a mold release liquid to the outer surface of the belt 49**.

The continuous belt 49 may contain a transverse weld 60. If the total length of the belt 49 corresponds to the standard cut-to-length dimension of the resulting coated fibrous batts, then the cut-to-length shear (not shown) may conveniently coincide with the impression of the weld 60 on the coating **48*b*, 48*c***.

It should be noted that the velocity of the belt 49 should coincide with the velocity of the fibrous pad 43 to avoid establishing shear stresses between the belt 49 and the coating 48*a*.

In a preferred embodiment the belt 49 has a smooth outer surface to generate a smooth surface 48*b* in the product coated fibrous batts. It is possible to provide a pattern in the belt 49 to produce a corresponding pattern on the coated surface of the coated fibrous batt 48*c*, for example, a diamond pattern, parallel lines, a decorative random pattern and the like.

The coated fibrous batts, prepared in accordance with this invention, have a smoother surface than corresponding coated batts prepared from the same coating composition on the same uncoated fibrous batts at the same application concentration and curing conditions. In addition the coatings prepared in accordance with this invention are dramatically tougher. There is no known standard means for measuring "toughness" of a coating on a fibrous batt. A subjective comparison can be established by attempting to poke a finger or a pencil through the coating into the random glass fibers forming the batt. According to such subjective tests, the coating prepared according to the present invention is tougher.

A typical coating composition comprises an aqueous acrylic emulsion including a catalyst to initiate cross-linking of the composition in response to applied heat. The coating composition also may include pigments, inert fillers, fire retardant particulate additives, bactericides, fungicides, biocides, rheology modifiers and curing catalysts. Typically the temperature of the ironing belt 49 is 400°–600° Fahrenheit. Typically the curing temperature in the oven 47 is 400°–700° Fahrenheit.

A typical froth coating used for coating glass fiber batts is:

| | Weight Percent |
|---|---|
| Aqueous Acrylic Latex Emulsion (Not-Pressure-Sensitive) | 20–90 |
| Curing Catalyst | 0.1–1:0 |
| Froth Aids | 1–10 |
| Foam Stabilizer | 1–5 |
| Mineral Filler, including Flame Retardants | 0–60 |
| Color Pigments | 0–5 |
| Rheology Control Thickener | 1–6 |
| Fungicide | 0.1–0.3 |

Final solids content is from 20 to 85 weight percent. Operating viscosity is 500 to 12,000 centipoise.

Froth density is measured as a "cup weight", i.e., the weight of frothed coating composition in a 16-ounce paper cup, level full. Cup weight of 55 to 255 grams is typical.

Figure 6:
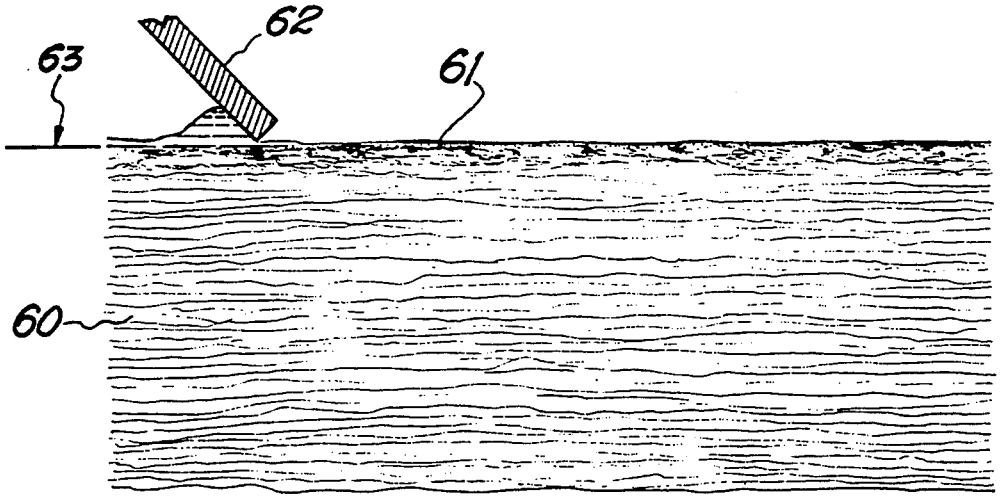
FIG. 6 is a fragmentary sectional view of a fibrous batt with uncured coating.
Figure 7:
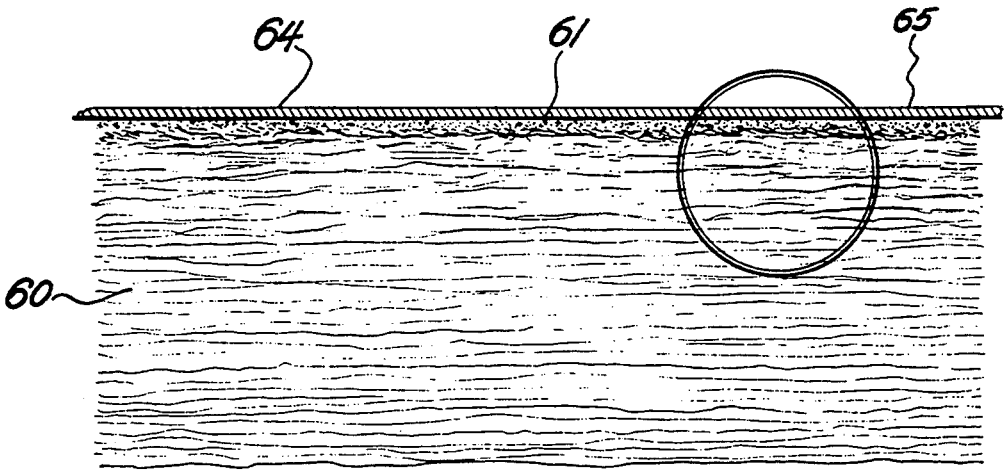
FIG. 7 is a fragmentary sectional view of a fibrous batt with a coating engaged with a heated ironing surface.
Figure 8:
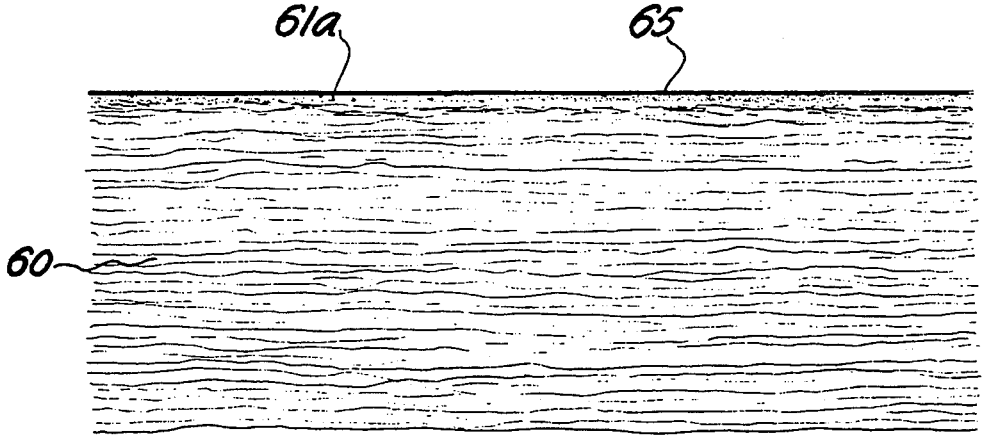
FIG. 8 is an enlarged sectional view of the circled section of FIG. 7.

The present process and product can be comprehended more clearly by reference to FIGS. 6, 7, 8, and 9 wherein a fibrous batt 60 receives a coating 61 of foamed or frothed cross-linkable elastomeric aqueous emulsion which is leveled to a more or less uniform thickness by means of a doctor blade 62 as shown in FIG. 6. As applied, the foamed or frothed coating 61 has a thickness of 5 to 30 mils, preferably about 10 mils. It will be observed from FIG. 6 that the applied coating 61 tends to follow the irregularities of the surface 63 of the fibrous batt 60, i.e., the coating 61 tends to penetrate downwardly into interstices between fibers and tends to rise above any fiber which extends above the general level 63 of the fibrous batt 60. In a prior art embodiment (not shown) the applied foamed or frothed coating 61 is directly heated in an oven which causes collapse of the foam or froth, elimination of the water content of the coating and cure of the elastomer as a thin film which follows the contours of the upper surface 63 of the batt 60.

According to this invention, the applied frothed or foamed coating 61 (FIG. 7) is engaged with a heated ironing surface 64 which creates a cured exposed film 65 which is dewatered and free of the foam or froth bubbles. The film 65 is essentially flat, corresponding to the configuration of the hot ironing surface 64, presenting a tough, difficult to penetrate-or-tear elastomeric skin. When the coated batt subsequently is heated in an oven, the final product (FIGS. 8, 9) has a relatively smooth exposed film 65 and the remainder of the coating 61*a* is dried, substantially freed of froth or foam bubbles and has penetrated into the interstices of the fibrous batt as indicated at 66 to achieve a good bond with the fibrous batt 60. The product presents a smooth, tough exposed surface 65 which improves the performance of the coated batt in thermal and acoustical insulation installations.

Figure 10:
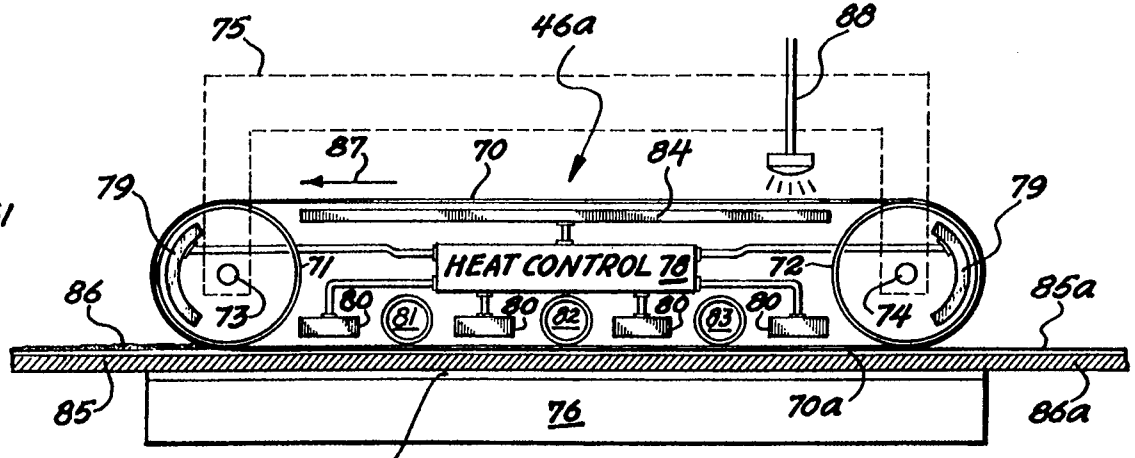
FIG. 10 is a schematic illustration of another embodiment of apparatus for practicing the invention.
Figure 9:
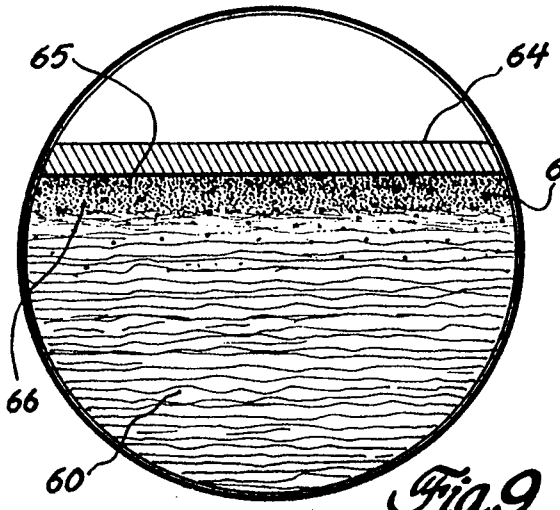
FIG. 9 is an enlarged fragmentary sectional view of a coated fibrous batt after the coating has been ironed and cured.

An alternative embodiment of the ironing apparatus 46*a* is illustrated in FIG. 10. A continuous belt 70 is positioned on two rollers 71, 72 which rotate about central axles 73, 74 which are driven by drive means, not illustrated in FIG. 10. The continuous ironing belt 70 has the same properties and characteristics as the ironing belt 49 described in connection with FIG. 4. The ironing apparatus 46*a* is secured to a frame 75 which includes means, not shown, for raising, lowering and holding the ironing apparatus 46*a* with respect to a support table 76 having a flat upper surface 77. Means for heating the continuous belt 70 are provided including a heat source 78 which controls delivery of heat to heat release devices 79, 80. Intermediate rollers 81, 82, 83 rotate about central axes (not shown). The continuous belt 70*a* is maintained in a generally flat surface. The rollers 81, 82, 83 are supported by the frame 75 by appropriate support means, not shown in FIG. 10. An additional heat release element 84 may be provided for the continuous belt 70 remote from the rollers 81, 82, 83.

In operation, the apparatus of FIG. 10 is positioned above a continuously advancing fibrous batt 85 which has on its upper surface a coating 86 of foamed or frothed cross-linkable coating composition. The continuous belt 70 advances in the direction indicated by the arrow 87 at the same velocity as the pad 85 and coating 86. The heated, continuous belt 70*a* contacts the upper surface of the coating composition 86 and provides a dried, tough, partially cured skin over the surface of the coating composition 86 which engages the continuous belt 70*a*. The pad 85*a* and partially cured coating 86*a* separate from the continuous belt 70 at the roller 72 and proceed to a heating chamber, similar to the heating chamber 47 of FIG. 4, for drying and final cure of the coating of the composition 89*a*.

The heating elements 79, 80, 87 may be gas burning radiant heat panels, may be infrared lamps, may be blocks of thermally conductive metals such as copper, copper alloys, aluminum, aluminum alloys, steel alloys and the like which will transmit heat readily to a continuous belt 70.

The apparatus of FIG. 10 differs from that illustrated in FIG. 4 primarily by having larger drive rolls 71, 72 and having intermediate rolls 81, 82, 83. Similar heat sources may be applied in the ironing apparatus 46 (FIG. 4) or 46*a* (FIG. 10). The distance between the axles 73, 74 is preferably from 4 to 10 feet. The diameter of the rollers 71, 72 is preferably 8 to 30 inches. If desired, an appropriate mold release agent may be applied to the outer surface of the continuous belt 70 from an appropriate distributor such as one or more spray nozzles 88.

I claim:

1. Apparatus for curing a surface film of a cross-linkable elastomeric aqueous emulsion coating composition applied to a surface of a fibrous batt wherein said coating penetrates said batt and conforms to the surface of said batt, said apparatus including:

a. support means having an upper surface to support said batt;

b. a continuous belt, having a temperature between 400° and 600° Fahrenheit, to engage the exposed surface of said coating and to compress said exposed surface of said batt against said support means;

c. means to heat said continuous belt to said temperature to drive off moisture from the exposed surface of said coating;

d. advancing means to advance said batt along said support means;

e. drive means to drive said continuous belt at the same linear velocity as the said advancing means, whereby there is no shear stress between said coating and said belt whereby a film of said coating in contact with said continuous belt is heated by said belt to drive off moisture from the film and to cure the cross-linkable emulsion of said film to a tough, cured state, said film generally conforming to the shape of said continuous belt; and f. a heating means downstream of said continuous belt for effecting a cure of that portion of said coating intermediate said film and said batt, said heating means having a temperature between 400° and 700° Fahrenheit, sufficient to drive off substantially all of the moisture in said coating intermediate said film and said batt to complete a cure of said coating.

2. The apparatus of claim 1, including: a means for applying a mold release agent to a surface of said continuous belt which engages said coating.

* * * * *